US007690530B2

(12) United States Patent
Schneider et al.

(10) Patent No.: US 7,690,530 B2
(45) Date of Patent: Apr. 6, 2010

(54) DISPENSER FOR VISCOUS MATERIAL

(75) Inventors: Mark Schneider, Morrestown, NJ (US); Joseph B. Hanni, Cherry Hill, NJ (US)

(73) Assignee: Albion Engineering Company, Moorestown, NJ (US)

( * ) Notice: Subject to any disclaimer, the term of this patent is extended or adjusted under 35 U.S.C. 154(b) by 449 days.

(21) Appl. No.: 11/430,223

(22) Filed: May 8, 2006

(65) Prior Publication Data

US 2008/0011784 A1 Jan. 17, 2008

Related U.S. Application Data

(60) Provisional application No. 60/678,306, filed on May 6, 2005.

(51) Int. Cl.
*B67D 1/00* (2006.01)

(52) U.S. Cl. ..... 222/63; 222/95; 222/105; 222/333; 222/390

(58) Field of Classification Search ..... 222/326, 222/333, 386, 390, 391, 95, 105, 325, 327, 222/63, 334
See application file for complete search history.

(56) References Cited

U.S. PATENT DOCUMENTS 3,208,638 A * 9/1965 Frenzel et al. ..... 222/39
4,273,269 A * 6/1981 Davis, Jr. ..... 222/326
5,184,757 A * 2/1993 Giannuzzi ..... 222/82
5,301,835 A 4/1994 Fulks et al.
5,301,839 A * 4/1994 Eierle et al. ..... 222/95
5,449,096 A * 9/1995 Sedlmeier ..... 222/386
5,556,009 A * 9/1996 Motzko ..... 222/326
5,909,830 A * 6/1999 Bates et al. ..... 222/327
6,082,596 A * 7/2000 Koch et al. ..... 222/390
6,223,941 B1 5/2001 Nealey

OTHER PUBLICATIONS

International Search Report for Application No. PCT/US 06/17633 dated Jul. 20, 2007.

* cited by examiner

*Primary Examiner*—Kevin P Shaver
*Assistant Examiner*—Daniel R Shearer
(74) *Attorney, Agent, or Firm*—Caesar, Rivise, Bernstein, Cohen & Pokotilow, Ltd.

(57) ABSTRACT

A dispenser for viscous material packaged in a collapsible sleeve includes a chamber for receiving the packaged material and a piston rod and piston assembly for compressing the collapsible sleeve to dispense the viscous material through a dispensing orifice in a closure removably retained on the forward end of the chamber. The piston assembly includes a movement-limiting member having a distal surface that extends forward of a piston for limiting movement of the piston rod and piston by engaging the peripheral surface of the closure. The movement-limiting member also has an outer peripheral surface that is positioned inwardly of an inner surface of the chamber to provide an annular compartment for receiving portions of the collapsible sleeve therein when the viscous material in the sleeve has been dispensed.

7 Claims, 3 Drawing Sheets

DISPENSER FOR VISCOUS MATERIAL

CROSS-REFERENCE TO RELATED APPLICATIONS

This application claims the benefit of provisional Application No. 60/678,306, filed May 6, 2005, which is incorporated herein in its entirety.

FIELD OF INVENTION

This invention relates generally to a dispenser for viscous material and more particularly to a piston assembly for improving the functionality of such a dispenser. More specifically this invention has its greatest utility in connection with automatically operated (e.g., pneumatic, hydraulic and/or electrically operated) high power dispensers, but also is useful in connection with manually operated, high power dispensers. In one preferred construction, the dispenser is a battery-operated, cordless dispenser.

BACKGROUND OF THE INVENTION

Dispensing guns, and in particular, battery-operated, cordless dispensing guns for dispensing viscous materials such as adhesives, caulking compounds and other sealants included in a collapsible package (i.e., sometimes referred to as a "sausage" or "chub" package) are known in the art. These sausage packages, as the name implies, have a generally elongate, sausage-like shape, and are provided with a flexible, collapsible outer sheath or sleeve that is sealed at its opposed ends for housing the viscous material to be dispensed. In use, one end of the sausage package is either opened or cut to permit the viscous material to be dispensed therefrom. This sausage package is placed in a cylindrical chamber of the dispensing gun and a piston is forced in a forward, or distal dispensing direction to collapse the sheath and force the viscous material out the end of the chamber. The chamber is closed at its dispensing end by a removable cap or closure that includes a dispensing nozzle extending therefrom.

A representative cordless dispenser for dispensing viscous material from sausage-type packages is sold by Albion Engineering Company as its 1000 Series. This caulking gun operates with a 12-volt power supply and includes a motor having a gear for driving a piston rod in a material-dispensing direction. Specifically, the piston rod includes gear teeth that communicate with a pinion gear driven by the motor, whereby operation of the motor results in the pinion gear meshing with the gear teeth of the piston rod to force the piston rod, and the piston attached thereto, in a forward, viscous-material dispensing direction. These cordless dispensers are well known in the art and do not need any further explanation.

A pneumatic prior art caulking gun employing a sausage, or chub package is disclosed in Nealey U.S. Pat. No. 6,223,941 and a hand-operated caulking gun employing a sausage, or chub package is disclosed in U.S. Pat. No. 5,301,835.

In prior art cordless caulking guns, a barrel having a cylindrical chamber is provided for housing the sausage-type package including the viscous material to be dispensed. The dispenser is prepared for operation by retracting the piston rod and the piston attached at a distal end thereof to provide a forward chamber section in the barrel into which the sausage-type package is placed. In some prior art dispensers the piston at the distal end of the piston rod is a plastic member, such as one identified by the trademark TEFLON, and this plastic member has a circular, peripheral edge that is closely adjacent, and preferably rubs against the inner surface of the cylindrical chamber as it is moved in a forward, dispensing direction. This results in the peripheral edge of the piston actually peeling the sausage package liner or casing from the inner wall of the cylindrical chamber of the barrel as the sausage package is being collapsed to dispense the viscous material out of the forward, or distal end of the cylindrical chamber. In this regard, the prior art devices include a closure that is removably attached to the distal end of the cylindrical chamber and a dispensing nozzle extends forwardly from the closure. The dispensing nozzle can be a separate member, or alternatively can be integrally formed as part of the closure. Thus, as the sausage package is collapsed by the forward movement of the piston rod and piston, the viscous material is forced out of the nozzle orifice to a desired location.

In order to ensure that an adequate quantity of viscous material is dispensed, the prior art cordless guns have been designed to continue to apply a force to the sausage package until a predetermined maximum force is detected by the motor, at which time the motor will stop advancing the piston but may continue to push with a predetermined maximum force. Alternatively, upon applying the predetermined maximum force the motor may automatically disengage from the piston rod or shut off. As an example, the Albion 1000 Series caulking gun is designed to automatically shut off when the force detected by the motor reaches a level of approximately 600 pounds. However, the force required to either shut off the motor or stop the motor from continuing to advancing the piston may, in general, be in the range of about 500-2,500 pounds.

In prior art dispensers the pressure build up that ultimately shuts off the motor occurs by the force imposed on the viscous material in the sausage package disposed between the piston at one end and an inner distal surface of the removable closure disposed at the opposed end. The high force build up that is required to shut the motor off can cause an uneven forced distribution about the periphery of the piston, thereby causing excessive wear and/or distortion of the piston edges. Thus, in subsequent uses of the dispenser a slight gap, or a reduction in frictional engagement occurs between the inner surface of the barrel chamber and the distal edge of the piston, which causes a portion of the outer sausage package to be caught, or trapped between the edge of the piston and the inner surface of the chamber as a result of the high force that is created between the piston and sausage package prior to the motor disengaging and/or shutting off. In prior art dispensers the motor either is electronically disengaged when a pre-set maximum force is reached or when the operator releases the motor-actuating button.

When a portion of the sausage package is trapped between the piston and inner surface of the chamber, it becomes extremely difficult to remove a spent sausage package from the gun, even when the cap is removed. First, it is very difficult to get a grasp on the distal end of the sausage package to apply a withdraw force thereto. Second, due to the trapping of a proximal end of the sausage liner between the piston and the inner surface of the chamber, it becomes messy and time consuming to free the dispensed package from the gun in order to permit a new package to be placed in the barrel chamber for subsequent dispensing. Moreover, due to excessive premature wear on the piston, it may become necessary to frequently change the piston, thereby increasing maintenance time and the cost of components.

Therefore, in view of the problems encountered in the prior art devices, a need exists for a more reliable dispenser, and more particularly, a cordless dispenser for sausage packages, which permits the reliable dispensing of viscous material from the sausage package without impairing the ability to easily remove a spent sausage package from the dispenser. It is to such an improved dispenser that the present invention relates.

SUMMARY OF INVENTION

In accordance with this invention a dispenser for viscous material packaged in a collapsible sleeve includes a barrel having an elongate chamber for housing the packaged, viscous material. The chamber includes an opening at a distal dispensing end and a closure removably retained on that distal end. The closure has a peripheral surface that partially overlies the opening at the distal end of the chamber and also includes a passage through which the viscous material can be dispensed as the sleeve containing the viscous material is being collapsed. A piston rod is positioned within the elongate chamber of the barrel and is movable in the direction of elongation of the chamber toward the distal end of the chamber to compress the collapsible sleeve and dispense the viscous material therein. A piston made from any suitable polymer is located at the forward end of the piston rod for engaging a portion of the proximal end of the collapsible sleeve as the viscous material is being dispensed by movement of the piston rod in a forward direction toward the distal dispensing end of the chamber. The piston includes an outer peripheral edge closely adjacent to, and preferably in sliding engagement with the inner surface of the barrel chamber for peeling the sleeve of the sausage package off the inner surface of the chamber and for preventing portions of the sleeve from becoming trapped between the outer peripheral edge of the piston and the inner surface of the chamber as the sleeve is being collapsed by movement of the piston rod in a forward direction. In accordance with this invention a movement-limiting member is moveable with the piston rod and piston, and this member includes a distal surface extending forward of the polymer piston for limiting forward movement of the piston rod and piston by engaging the peripheral surface of the closure; the movement-limiting member having an outer peripheral surface disposed inwardly of the inner surface of the barrel chamber to provide an annular compartment between the outer peripheral surface of the movement-limiting member and the inner surface of the chamber in which portions of the collapsible sleeve are received when the viscous material in the sleeve has been dispensed.

Reference throughout this application to the distal surface of the movement-limiting member engaging the peripheral surface of the closure, or terms of similar import, includes the situation in which a portion of the outer lining of the package, or even a minor portion or layer of the viscous material to be dispensed, is trapped between the distal surface of the movement-limiting member and the peripheral surface of the closure. The important feature is that substantially the entire force imposed on the piston rod and therefore on the motor is essentially the force created between the distal surface of the movement-limiting member and the peripheral surface of the closure.

Reference throughout this application to "peripheral surface of the closure" or words of similar import, unless specifically stated otherwise, includes within its scope the peripheral surface of a flange of a nozzle inserted into a closure. In fact, in the preferred embodiment the closure includes a threaded metal cap that is removably retained on the distal end of the barrel of the dispenser, and a plastic nozzle retained within a central passage through the base of the cap by a flange of the nozzle overlying a peripheral wall of the metal cap. However, as stated earlier the cap, including the nozzle, can be formed as a unitary member.

Reference throughout this application to the dispensers being "automatically operated" means a mode of operation other than operating the dispensers through an actuating force manually-applied by a user, and includes dispensers that are pneumatically operated, hydraulically operated and electrically operated.

One preferred automatically operated dispenser in accordance with this invention is a battery-operated, cordless dispenser and the description that follows will be directed to such a dispenser. However, it should be understood that this invention relates to other automatically operated dispensers (e.g., pneumatic and hydraulic) as well as to high-thrust, manually-operated dispensers. The most preferred applications are in connection with automatically operated dispensers.

In one preferred embodiment of this invention the dispenser includes a motor for driving the piston rod, the piston and the movement-limiting member in a forward dispensing direction until a predetermined force is sensed by the motor, at which time the motor discontinues applying a driving force through the piston rod. The predetermined force is created by the force of engagement between the distal surface of the movement-limiting member and the peripheral surface of the closure as said piston rod is being forced in a forward dispensing direction. In other words, that dispensing force initially is directly applied to the bulk of the viscous material being dispensed from the barrel. By the time that the distal surface of the movement-limiting member engages the peripheral surface of the closure that overlies the barrel chamber, virtually all of the viscous material that was intended to be dispensed actually has been dispensed. This occurs before an excessive force build up is created between the sausage package and the peripheral edge of the piston.

Thus, in accordance with this invention the build up of a predetermined force for shutting off the motor does not require the build up of an excessively high force imposed by the piston upon the viscous material within the collapsible sleeve. Rather, the predetermined force is imposed between the movement-limiting member and the peripheral surface of the closure, and the movement-limiting member is dimensioned to engage the peripheral surface of the closure prior to the build up of an excessively high, potentially piston-damaging force between the piston and the viscous material within the sausage package.

In the preferred embodiment of this invention the distal surface of the movement-limiting member and the peripheral surface of the closure engage each other at a location whereat the piston rod is capable of moving an additional distance in the forward dispensing direction when the closure is removed from the distal edge of the chamber. In other words, the piston rod is not at the end of its forward stroke at the time the peripheral surface of the movement-limiting member engages the peripheral surface of the closure. This permits a forward, or distal, portion of the collapsible sleeve to be forced out of the distal end of the barrel chamber after the dispensing operation is complete, by first removing the closure and then moving the piston rod forwardly to force a forward portion of the sausage package beyond the distal end of the barrel chamber to permit the sausage package to be easily grasped and removed from the barrel chamber.

In the most preferred dispenser the proximal end of the piston rod is in the form a gear rack and the motor includes a driven gear that cooperates with the gear rack for driving the piston rod in a forward, material-dispensing direction.

Most preferably, when the barrel of the dispenser is of a standard length, the movement-limiting member is provided with an inwardly directed cavity in a distal end thereof. This permits the sausage package to fit within the barrel by providing a cavity for receiving the proximal end of the sausage package. If a longer barrel is included on the dispenser it may not be necessary to include an inwardly directed cavity in the distal end of the movement-limiting member. In either case, the movement-limiting member includes an outer peripheral surface for engaging the peripheral surface of the closure.

DETAILED DESCRIPTION OF THE INVENTION

Figure 1:
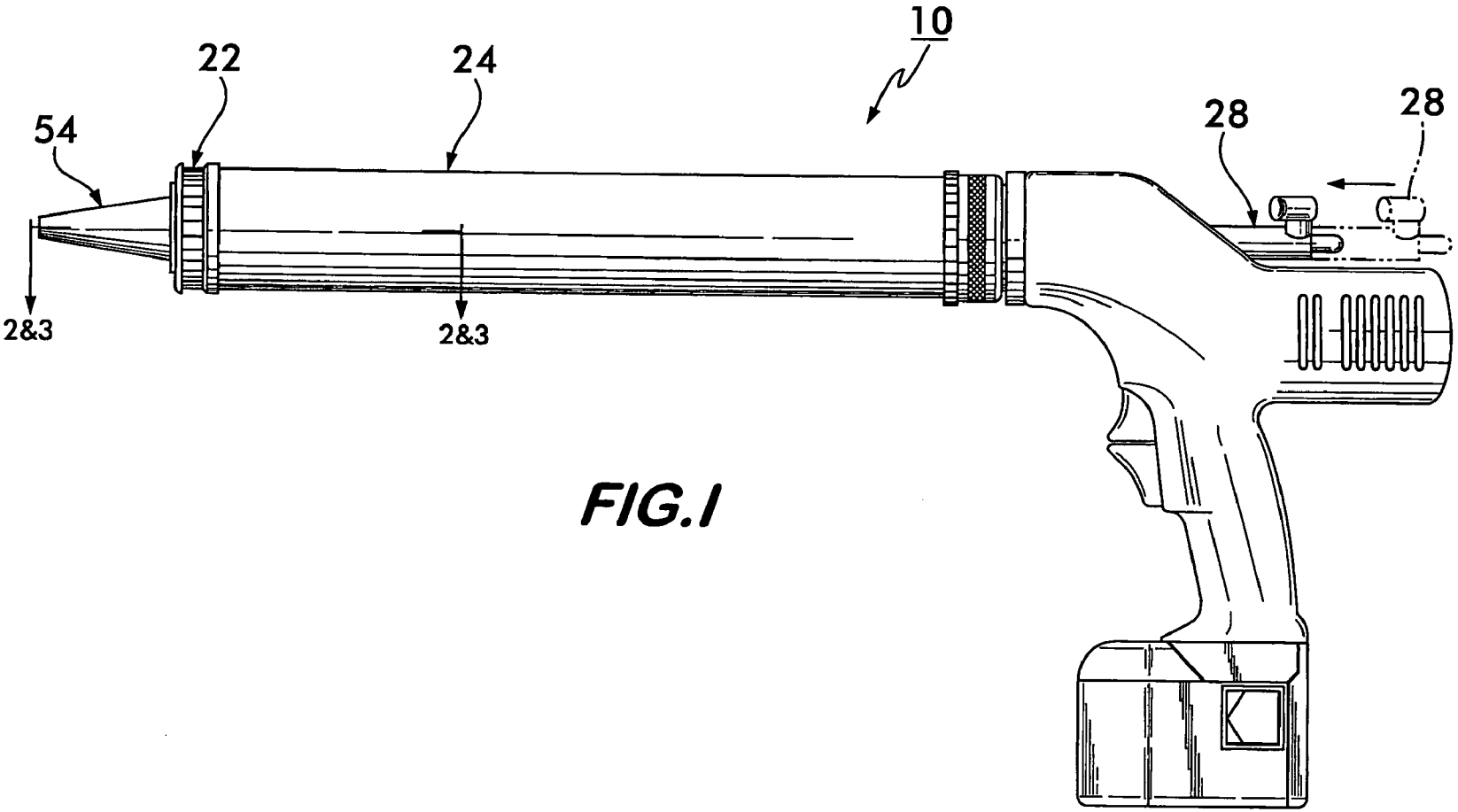
FIG. 1 is a side elevational view of a dispenser in accordance with this invention.
Figure 2:
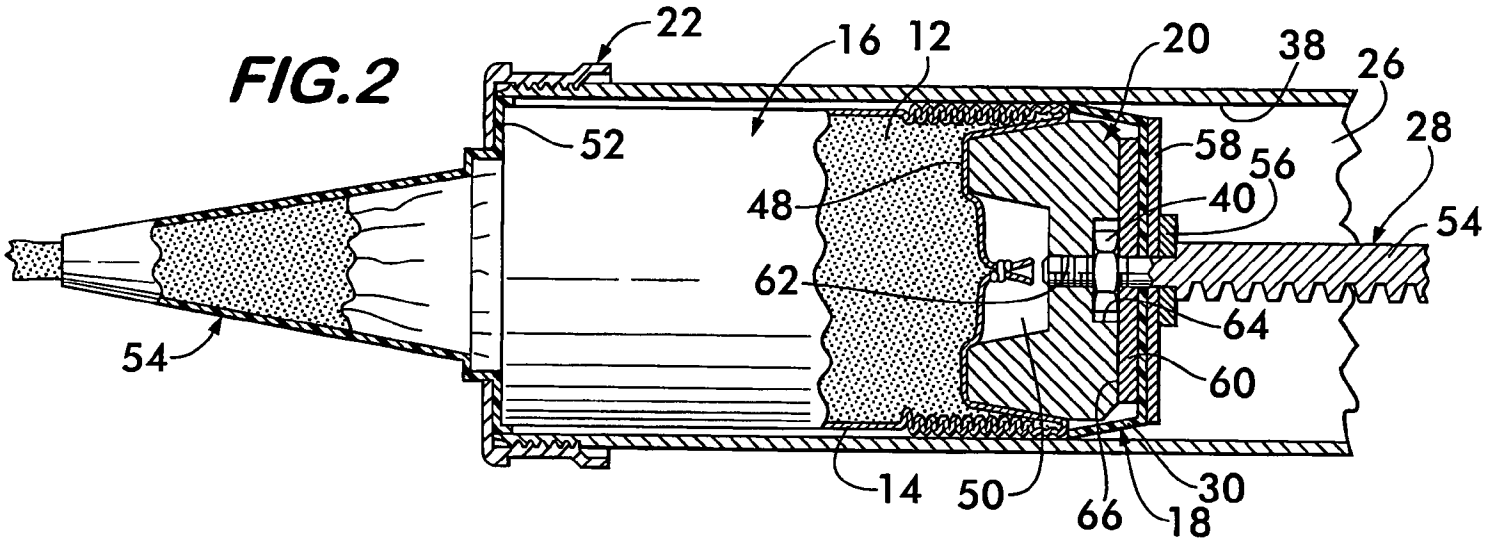
FIG. 2 is a fragmentary side elevational view of the dispensing end of the dispenser with parts broken away to show details of construction and with the viscous material only partially dispensed.
Figure 3:
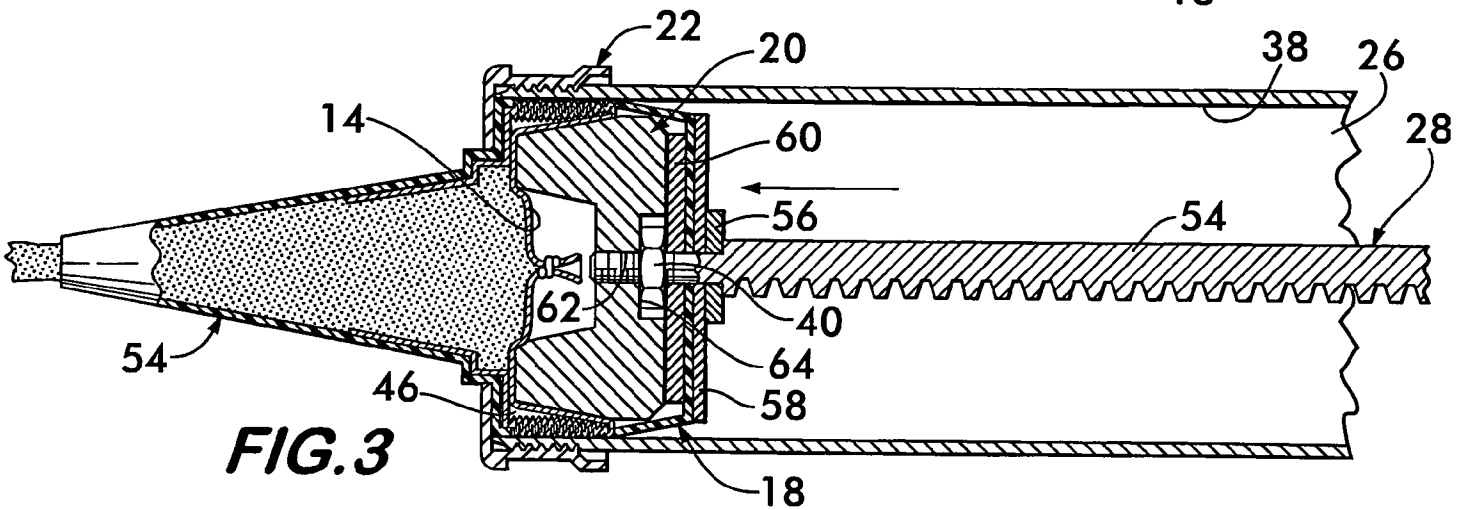
FIG. 3 is a view similar to FIG. 2, but showing the dispenser at the end of its dispensing stroke.

An automatically operated dispenser 10 for viscous material 12 packaged in a collapsible sleeve 14 of a sausage, or chub, package 16 in accordance with this invention is generally shown in FIGS. 1-3.

In particular, the present invention relates to a unique cooperation among a polymer piston 18, a movement-limiting member 20 secured to the piston and a closure 22 at the distal end of barrel 24. The barrel 24 includes an internal, elongate chamber 26 in which collapsible package 16 of viscous material 12 is positioned for subsequent dispensing, as is illustrated best in FIGS. 2 and 3.

It should be understood that the general configuration of the dispenser 10 illustrated in FIG. 1 is known in the art, and is being sold by Albion Engineering Company, the assignee of this invention, as its Series 1000 cordless, battery-operated dispenser. The features of the motor, actuating mechanism and cooperation between piston rod 28 and a driving gear driven by the motor (not shown) are convention structures well known to individuals skilled in the art and do not need or require any further explanation herein.

Referring to FIG. 1, the piston rod 28 is shown in an intermediate position in phantom representation and in a more forward dispensing direction in solid representation. When the piston rod 28 is in the phantom position shown in FIG. 1, the piston 18 and movement-limiting member 20 are in the position illustrated in FIG. 2, and when the piston rod 28 is in the position of solid representation in FIG. 1, the piston 18 and movement-limiting member 20 are in the position illustrated in FIG. 3. It should also be noted that in accordance with a preferred feature of this invention, upon removal of the closure 22 from the end of the barrel, the piston rod 28 is capable of being moved an additional distance in a forward direction to permit easy removal of the spent sausage package 16, as will be explained in greater detail hereinafter.

Figure 4:
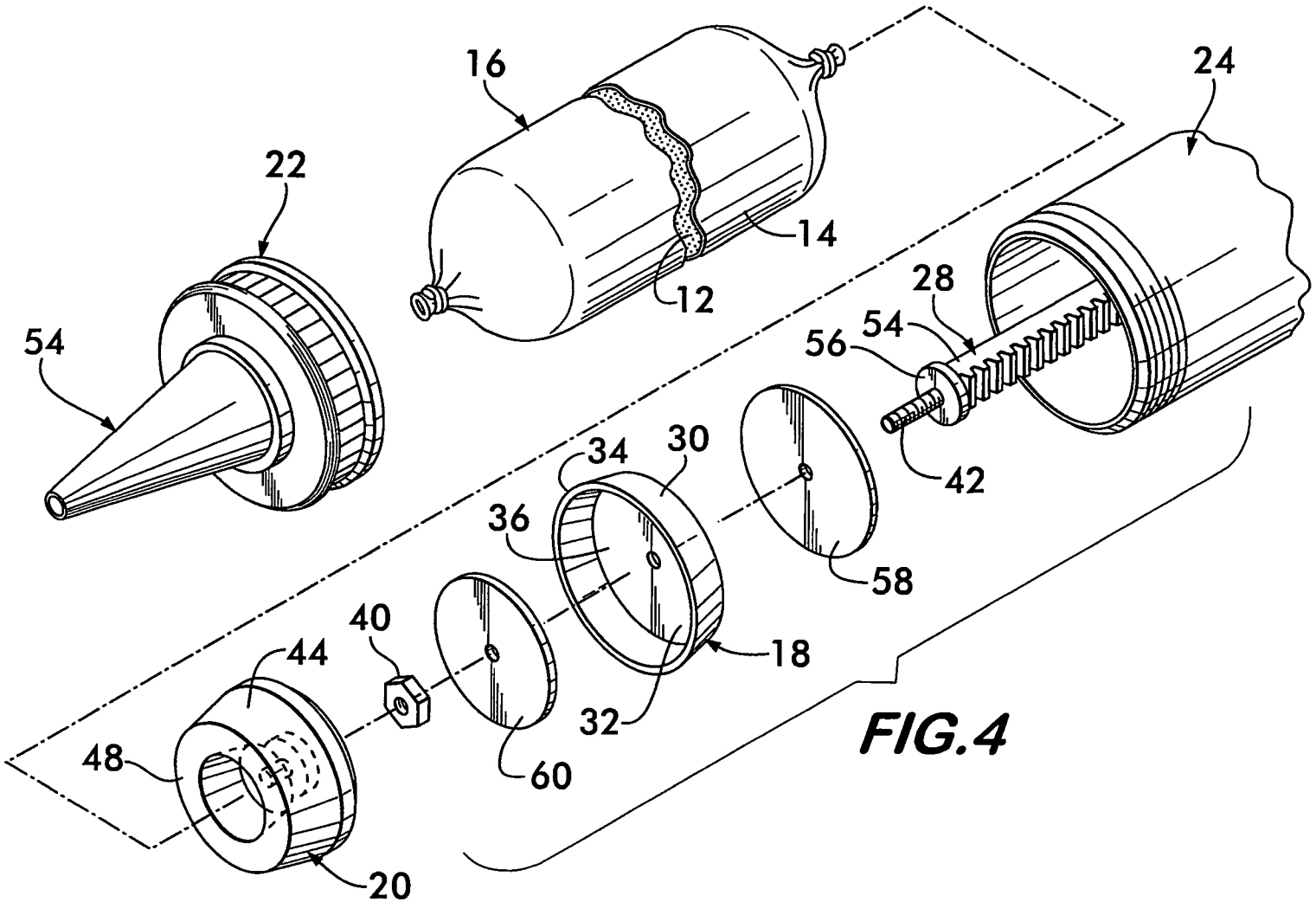
FIG. 4 is an exploded isometric view of various components of the dispenser in accordance with this invention.

It should be noted that the piston 18 that can be utilized in this invention, as illustrated in FIGS. 2-4, is of a convention, prior art design and preferably is a Teflon piston made from TEFLON polymer having an inclined piston wall 30 joined at its proximal end to a base 32 [see FIG. 4] and terminating at its distal end in an outer, peripheral distal edge 34 [see FIG. 4]. This structure defines an internal piston compartment 36 [see FIG. 4]. Referring to FIGS. 2 through 4, the piston 18 is dimensioned so that the distal edge 34 thereof is closely adjacent to inner surface 38 of the internal barrel chamber 26 and most preferably is in rubbing engagement with said inner surface as said piston 18 is moved in a forward dispensing direction by the driven movement of piston rod 28.

A unique feature of the present invention resides in the provision of the movement-limiting member 20, which preferably is a metal member made of aluminum. However, the movement-limiting member can be made of other materials, including plastic. The specific material employed in forming the movement-limiting member is not considered a limitation on the broadest aspects of this invention.

Referring to FIGS. 2-4, the movement-limiting member 20 has a threaded passage 62 in a base section thereof, and this threaded passage receives a threaded end 42 of the piston rod 28 to removably attach the movement-limiting member to the piston rod. The movement-limiting member 20 has an outer peripheral surface 44 [see FIG. 4] that is disposed inwardly of the inner surface 38 of the internal chamber 26 of barrel 24 to provide an annular compartment 46 in which portions of the collapsed sleeve can be received, in an accordion pleated arrangement, as can be seen best in FIGS. 2 and 3. It should be noted that the lead line from 46 is located inside the sausage package due to dimensional constraints in the drawings. However, the region in which the lead line is located does depict the annular chamber when the sausage package is not in the dispenser.

Referring to FIGS. 2-4, the movement-limiting member 20 has a distal surface 48 that extends forward of the peripheral edge 34 of the piston 18. In the illustrated embodiment the distal surface 48 of the movement-limiting member 20 is an annular surface provided with an inwardly directed cavity 50. In this construction the cavity 50 is designed to receive the proximal end of the sausage package 16 therein prior to actuation of the dispenser 10 to collapse the sleeve and dispense the viscous material. It should be apparent that prior to operating the dispensing gun 10 the distal end of the collapsible sleeve 14 preferably is cut, or opened, to permit the dispensing of the viscous material 12 out of the distal end of the sleeve as said sleeve is being collapsed. The provision of the cavity 50 provides an additional elongate dimension to insure that sufficient space exists at the distal end of the barrel chamber 26 for receiving the sausage package when the piston rod 28 is fully retracted.

It should be understood that in accordance with the broadest aspects of this invention the distal surface 48 of the movement-limiting member does not need to be a continuous annular surface, but could be provided by discrete projections spaced about the periphery to provide spaces between those projections. The use of discrete projections is less preferred because it may result in the dispensing of less material from the sausage package when the piston is driven through its full operating stroke to bring the distal surfaces of the projections into engagement with the internal peripheral surface 52 of the closure 22. As stated earlier, the internal peripheral surface 52 may actually be the internal peripheral surface of a flange of a dispensing nozzle 54 secured to, or retained within a metal cap of the closure 22.

In accordance with the broadest aspects of this invention, the important feature is that the distal surface 48, (or distal surfaces in the event that discrete, spaced-apart projections are included in the construction of the movement-limiting member) of the movement-limiting member 20 extend(s) outwardly beyond the peripheral edge 34 of the piston 18, and that the movement-limiting member be designed such that the required force to disengage operation of the dispenser motor be established between the distal surface(s) 48 of the movement-limiting member and the peripheral surface 52 of the removable closure 22 (which may the peripheral surface of a dispensing nozzle 54 forming part of the closure, either with or without a portion of the sleeve and/or a small portion of the viscous material trapped therebetween).

As stated earlier, reference to the distal surface(s) 48 of the movement-limiting member 20 engaging the inner peripheral surface 52 of the removable closure 22 also includes the cooperation that exists between these latter surfaces with a portion of the collapsible sleeve 14 and/or a small portion of the viscous material 12 of the sausage package 16 being trapped between them. This still results in the build up of the predetermined force for shutting off the motor of the dispenser before an excessively high force is imposed upon the peripheral edge 34 of the piston 18.

In other words, in accordance with this invention, applicant does not rely upon a build up of a predetermined compressive force between a piston and a large volume of the viscous material being dispensed to establish the necessary force for discontinuing the operation of the dispensing gun. In accordance with the present invention, the necessary force for shutting off the motor to discontinue the operation of the dispensing gun 10 takes place without creating an excessively high and uneven force distribution on the edge 34 of the piston 18 imposed by the viscous material 12 being dispensed. If such an excessive and uneven force distribution did occur, it could create uneven and excessive wear of the piston edge 34. This uneven or excessive wear of the piston edge 34, as explained earlier in this application, may result in the collapsible sleeve 14 of the sausage package 16 becoming trapped, or jammed, between the edge of the piston and the inner surface of the chamber during the dispensing operation, thereby making it extremely difficult and messy to remove the spent package of viscous material from the internal barrel chamber at the end of the dispensing operation.

In the present invention, the required force for disengaging the operation of the dispenser 10 is established between the confronting peripheral surface 52 of the removable closure 22 and the distal surface(s) 48 of the movement-limiting member 20, and is established at a point in the dispensing stroke wherein a desired amount of the viscous material has been dispensed, but without creating an excessive force build up at the interface between the sausage package 16 and the peripheral edge 34 of the piston 18, which could cause either uneven or excessive wear of the piston edge.

Referring to FIG. 4, in conjunction with FIGS. 2 and 3, the manner in which various components are assembled will be described.

Referring to FIGS. 2-4, the piston rod 28 includes a proximal end 54 in the form of a rack gear, and the distal end is swaged to provide the threaded cylindrical section 42. Two washers 56 and 58 are inserted over the threaded cylindrical section 42 on the rear side of the polymer piston 18. The piston 18 is then inserted over the cylindrical section 42 of the piston rod 28 and another washer 60 is inserted over the threaded end into the cavity 36 of the piston. The threaded nut 40 is then threaded onto the distal end 42 of the piston rod 28 to firmly secure the piston 18 to the piston rod between the washers 58 and 60. The features described thus far are conventional and do not embody the features of the present invention.

The present invention resides in the inclusion of the movement-limiting member 20 on the piston 18 by providing an internally threaded passage 62 through the base of the movement limiting member that can then be threaded onto the distal end 42 of the piston rod 28. This arrangement is seen best in FIGS. 2 and 3. It should be noted, that a countersunk region 64 is provided in a rear surface of the movement-limiting member 20 to receive the threaded nut 40 therein. If desired, although not required, rear surface 66 of the movement-limiting member 20 can be maintained in engagement with the washer 60. As explained earlier, as a result of this construction a peripheral, or annular collecting chamber or compartment 46 is provided between the inner surface 38 of the barrel 24 and the peripheral outer surface 44 of the movement limiting member 20 to receive the collapsed sleeve created by the dispensing of the viscous material. This can be seen best in FIG. 3, where the collapsed sleeve assumes an accordion folded configuration within the collecting chamber 46.

In addition, the distal surface 48 of the movement-limiting member 20 applies a compressive force in cooperation with the peripheral surface 52 of the removable closure 22 to permit the build up of the necessary force to discontinue operation of the dispensing function without imposing an excessive force between the sausage package 16 and the peripheral edge 34 of the piston 18.

While this invention has been described in detail with reference to the specific examples thereof, it will be apparent to those skilled in the art that various changes and modifications can be made therein without departing from the spirit and scope thereof, the scope of the invention being specified in the appended claims.

What is claimed is:

1. A dispenser for viscous material packaged in a collapsible sleeve, said dispenser including a barrel having an elongate chamber for housing said viscous material packaged in said collapsible sleeve, said chamber including an opening at a distal dispensing end thereof, a closure removably retained on said distal end and having a peripheral surface partially overlying said opening and including a passage therein through which said viscous material can be dispensed as said sleeve is being collapsed, a piston rod within said elongate chamber and movable in the direction of elongation of said chamber, a piston connected to a forward end of said piston rod to move as a unit with said piston rod for engaging a portion of said collapsible sleeve as said viscous material is being dispensed by movement of said piston rod in a forward direction toward the distal dispensing end of said chamber, said piston including an outer peripheral edge closely adjacent an inner surface of said chamber, a movement limiting member connected to the piston rod and movable as a unit with said piston rod and piston, said movement limiting member including a distal surface extending forward of the piston a fixed distance from the outer peripheral edge of said piston and having a transverse dimension for engaging said peripheral surface of said closure to limit forward limiting movement of said piston rod and piston, said movement limiting member having an outer peripheral surface disposed inwardly of the inner surface of said chamber to provide an annular compartment defined by the piston, said outer peripheral surface of said movement limiting member and the inner surface of said chamber, portions of said collapsible sleeve being received in said annular compartment when the viscous material in said sleeve has been dispensed and the distal surface of the movement limiting member is in engagement with said peripheral surface of said closure, including a motor means for driving said piston rod and the piston and movement limiting member moveable with said piston rod in a forward dispensing direction until detection by said motor means of a predetermined force of engagement between the distal surface of said movement limiting member and the peripheral surface of said closure and thereafter discontinuing applying a driving force to said piston rod prior to a build up of an excessively high, potentially piston-damaging force between the piston and the viscous material being dispensed.

2. The dispenser of claim 1, said piston being formed of a polymer.

3. The dispenser of claim 1, wherein said distal surface of said movement limiting member and the peripheral surface of said closure engage each other with the piston rod capable of moving an additional distance in said forward dispensing direction when said closure is removed from the distal end of said chamber, whereby a forward or distal portion of the collapsible sleeve can be forced out of the distal end of the chamber by further forward movement of the piston rod to permit the sleeve to be grasped for removal from the chamber.

4. The dispenser of claim 1, wherein said motor means is a battery operated electric motor.

5. The dispenser of claim 1, wherein a proximal end of said piston rod is in the form of a gear rack, said gear rack being adapted to be driven by the motor means, said motor means including a drive gear adapted to cooperate with said gear rack for driving said piston rod in a forward dispensing direction.

6. The dispenser of claim 1, wherein said movement limiting member includes a cavity in a distal end thereof for receiving a proximal end of the packaged viscous material to be dispensed.

7. The dispenser of claim 2, wherein said movement limiting member includes a central cavity in a distal end thereof for receiving a proximal end of the packaged viscous material to be dispensed, said central cavity being independent and separated from said annular chamber.

* * * * *